US012704041B2

(12) United States Patent
Greci et al.

(10) Patent No.: US 12,704,041 B2
(45) Date of Patent: Aug. 11, 2026

(54) SAND SCREEN JOINT WITH PRODUCIBLE CHECK BALL

(71) Applicant: Halliburton Energy Services, Inc., Houston, TX (US)

(72) Inventors: Stephen Michael Greci, Carrollton, TX (US); Ryan W. McChesney, Carrollton, TX (US); Ryan M. Novelen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/022,193

(22) Filed: Jan. 15, 2025

(65) Prior Publication Data

US 2026/0201774 A1 Jul. 16, 2026

(51) Int. Cl.

| | |
|---|---|
| ***E21B 34/06*** | (2006.01) |
| ***E21B 34/10*** | (2006.01) |
| ***E21B 43/08*** | (2006.01) |
| ***E21B 43/12*** | (2006.01) |

(52) U.S. Cl.

CPC ..... *E21B 34/063* (2013.01); *E21B 34/10* (2013.01); *E21B 34/102* (2013.01); *E21B 43/08* (2013.01); *E21B 43/12* (2013.01); *E21B 2200/04* (2020.05)

(58) Field of Classification Search

CPC ..... E21B 34/063; E21B 34/10; E21B 34/102; E21B 43/08; E21B 43/12; E21B 2200/04

See application file for complete search history.

(56) References Cited

U.S. PATENT DOCUMENTS

| | | | | |
|---|---|---|---|---|
| 7,775,283 | B2 | 8/2010 | Coronado et al. | |
| 8,485,225 | B2 | 7/2013 | Veit | |
| 11,542,795 | B2 | 1/2023 | Yin et al. | |
| 11,952,873 | B1 * | 4/2024 | El Mallawany | E21B 43/12 |
| 2006/0027377 | A1 | 2/2006 | Schoonderbeek et al. | |
| 2011/0030969 | A1 | 2/2011 | Richards | |
| 2011/0303420 | A1 | 12/2011 | Thorkildsen et al. | |
| 2013/0025872 | A1 * | 1/2013 | Mailand | E21B 34/10 166/332.1 |
| 2014/0262207 | A1 * | 9/2014 | Lopez | E21B 43/12 166/114 |
| 2014/0367116 | A1 | 12/2014 | Lopez | |

(Continued)

OTHER PUBLICATIONS

Foreign Communication from Related Application—International Search Report and Written Opinion of the International Searching Authority, International Application No. PCT/US2025/014718, dated Sep. 30, 2025, 9 pages.

*Primary Examiner* — Neel Girish Patel

(74) *Attorney, Agent, or Firm* — Conley Rose, P.C.; Rodney B. Carroll

(57) ABSTRACT

A joint for a sand screen assembly includes a mandrel disposed inline with a screen jacket. A first passageway extends through the mandrel to an inner circumferential surface of the mandrel. A second passageway extends through the mandrel to the first passageway. A first ball or disc seat is formed in the first passageway. The joint further includes a retainer disposed in the second passageway, a shear member affixing the retainer to the mandrel, and a first check ball or disc disposed in the first passageway. The first check ball or disc is constrained by the first ball or disc seat and the retainer. A diameter of the first check ball or disc is less than a diameter of the first passageway at the inner circumferential surface.

20 Claims, 8 Drawing Sheets

(56) References Cited

U.S. PATENT DOCUMENTS

| | | | | |
|---|---|---|---|---|
| 2017/0234113 | A1* | 8/2017 | Steele | E21B 41/0035<br>166/381 |
| 2021/0156235 | A1* | 5/2021 | Yin | E21B 33/12 |
| 2021/0207453 | A1 | 7/2021 | Sladic | |
| 2024/0392651 | A1* | 11/2024 | El Mallawany | E21B 34/14 |

* cited by examiner

SAND SCREEN JOINT WITH PRODUCIBLE CHECK BALL

BACKGROUND

Hydrocarbons, such as oil and gas, are commonly obtained from subterranean formations that may be located onshore or offshore. The construction of a hydrocarbon producing well can comprise a number of different steps. Typically, the construction begins with drilling a wellbore at a desired wellsite, treating the wellbore to optimize production of hydrocarbons, and installing completion equipment to produce the hydrocarbons from the subterranean formation. During production of the formation fluid, formation sand may be swept into the flow path. The formation sand tends to be relatively fine sand that can erode production components in the flow path.

When formation sand is expected to be encountered in formation fluid, a lower completion assembly may be installed in the production zone between the formation and the production tubing. The lower completion assembly may include sand screen assemblies. Each sand screen assembly generally includes a filter media, such as a sand screen, to filter fines from the formation fluid. The inflow of formation fluids can be balanced across the sand screen assembly inflow control devices ("ICDs") that are configured to meter the inflow of formation fluids along the length of a lower completion assembly.

Often times operators will require washpipe to be installed on the inside of perforated screen joints to enable fluids to be pumped out of the toe during run in hole. This can help reduce the risk of sticking screens during run in hole and allow for proper well bore clean up. It may also be desirable for operators to be able to pressurize the inside of the screen joints to hydraulically set packers after the screens are in their final position. All of these operations may require the inside of the screen joints to be able to hold pressure in the burst direction or a secondary washpipe string to be run. However, screens are inherently permeable and deploying washpipe can be time consuming and expensive. The system and method of the present disclosure may address one or more these issues. For example, the system and method of the present disclosure may disable a washpipe-free mechanism to allow for injection flow into the formation at a later date.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

Hydrocarbons, such as oil and gas, are produced or obtained from subterranean reservoir formations that may be located onshore or offshore. The processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During the completion operations, a completion string, for example, a packer and at least one sand screen, may be used to isolate a production zone when erosive sand particles are present or predicted within the fluids produced from the formation, e.g., production fluids. The completion operation can comprise an upper completion string and a lower completion string, also referred to as a lower completion assembly. A lower completion assembly may comprise at least one sand screen comprising a base pipe with a flow passage and a filter media (sand screen), disposed around a portion of the base pipe. The filter media can be formed with a filtered flow area formed between the filter media and the base pipe.

Figure 1:
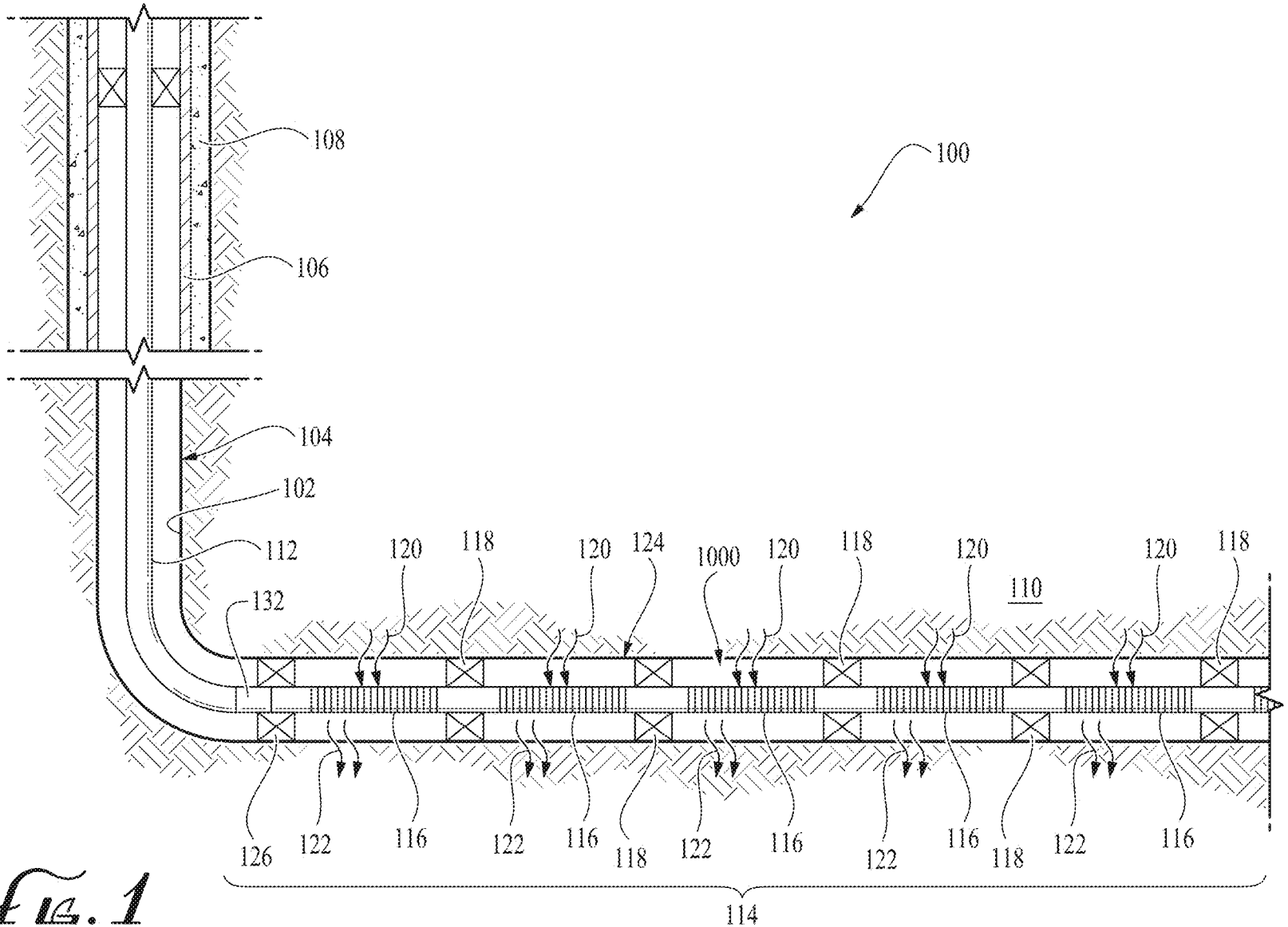
FIG. 1 is a schematic diagram of an exemplary wellsite environment, according to an embodiment of the present disclosure.
Figure 2:
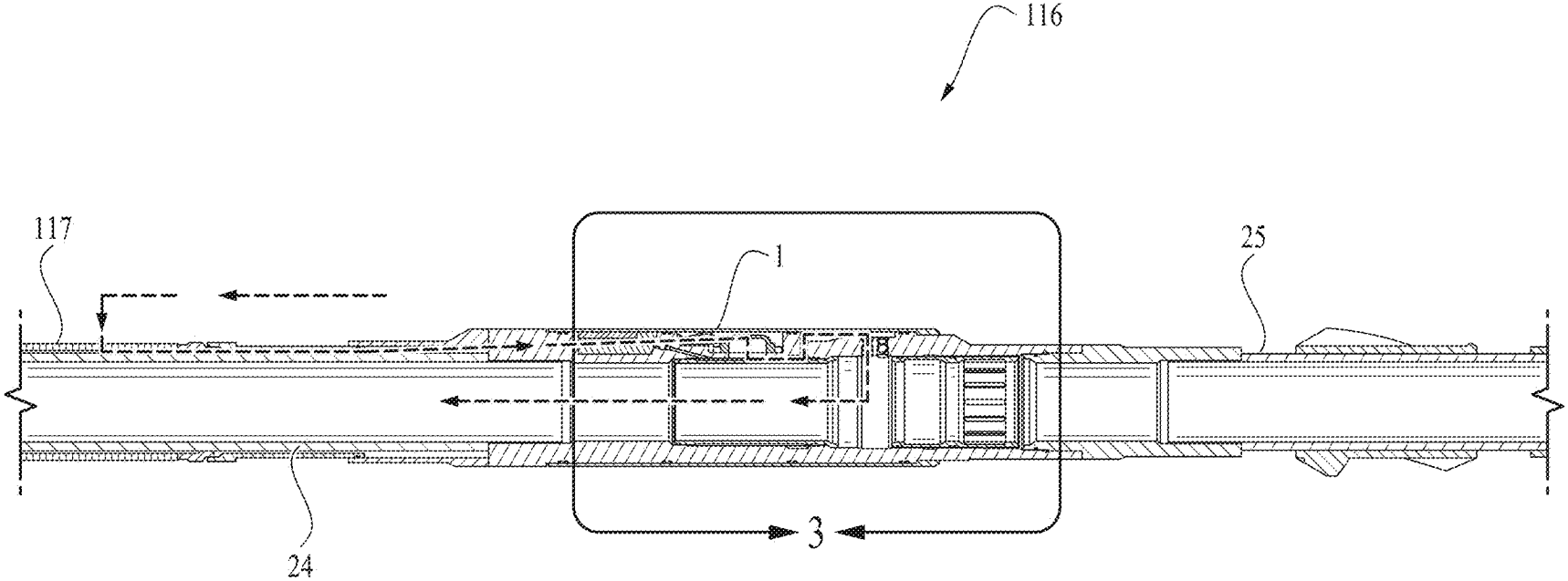
FIG. 2 is a cross-sectional side view of a sand screen assembly, according to an embodiment of the present disclosure.
Figure 3:
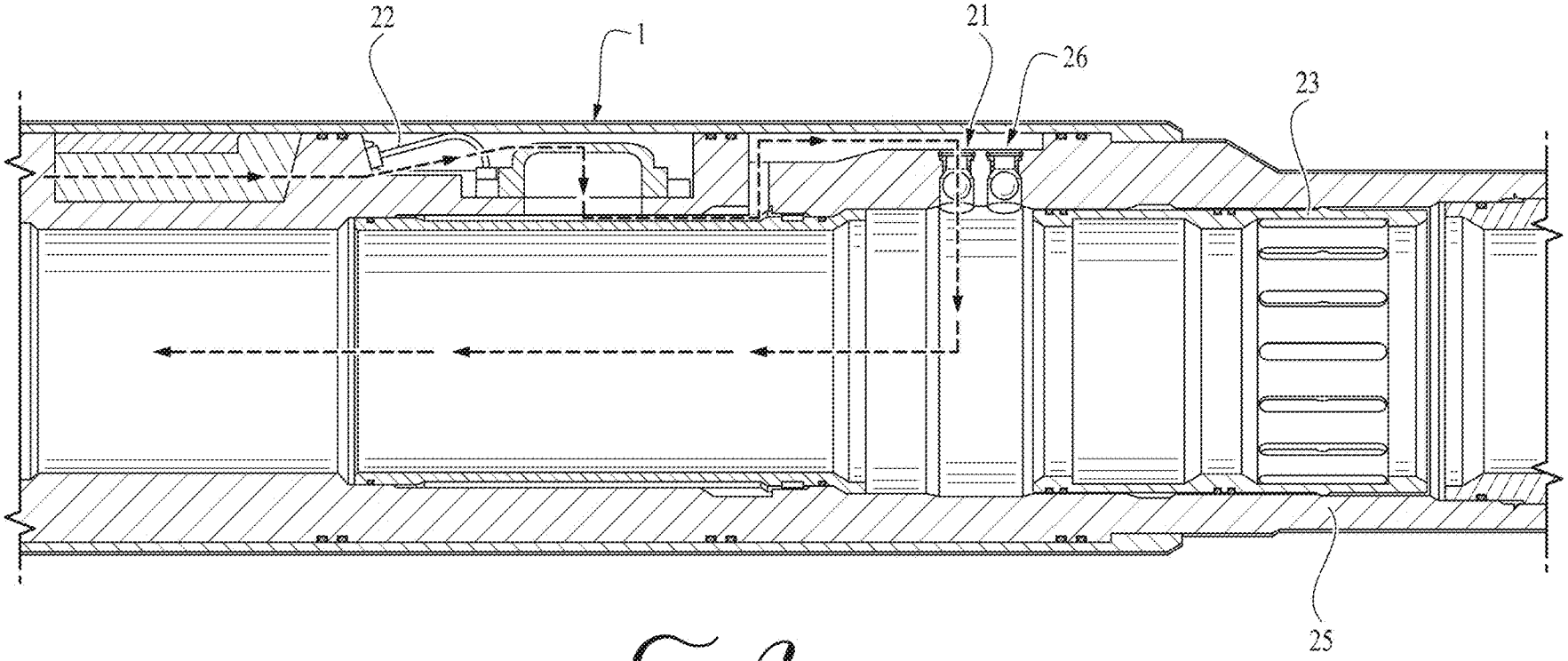
FIG. 3 is an enlarged cross-sectional side view of the sand screen assembly of FIG. 2.
Figure 4A:
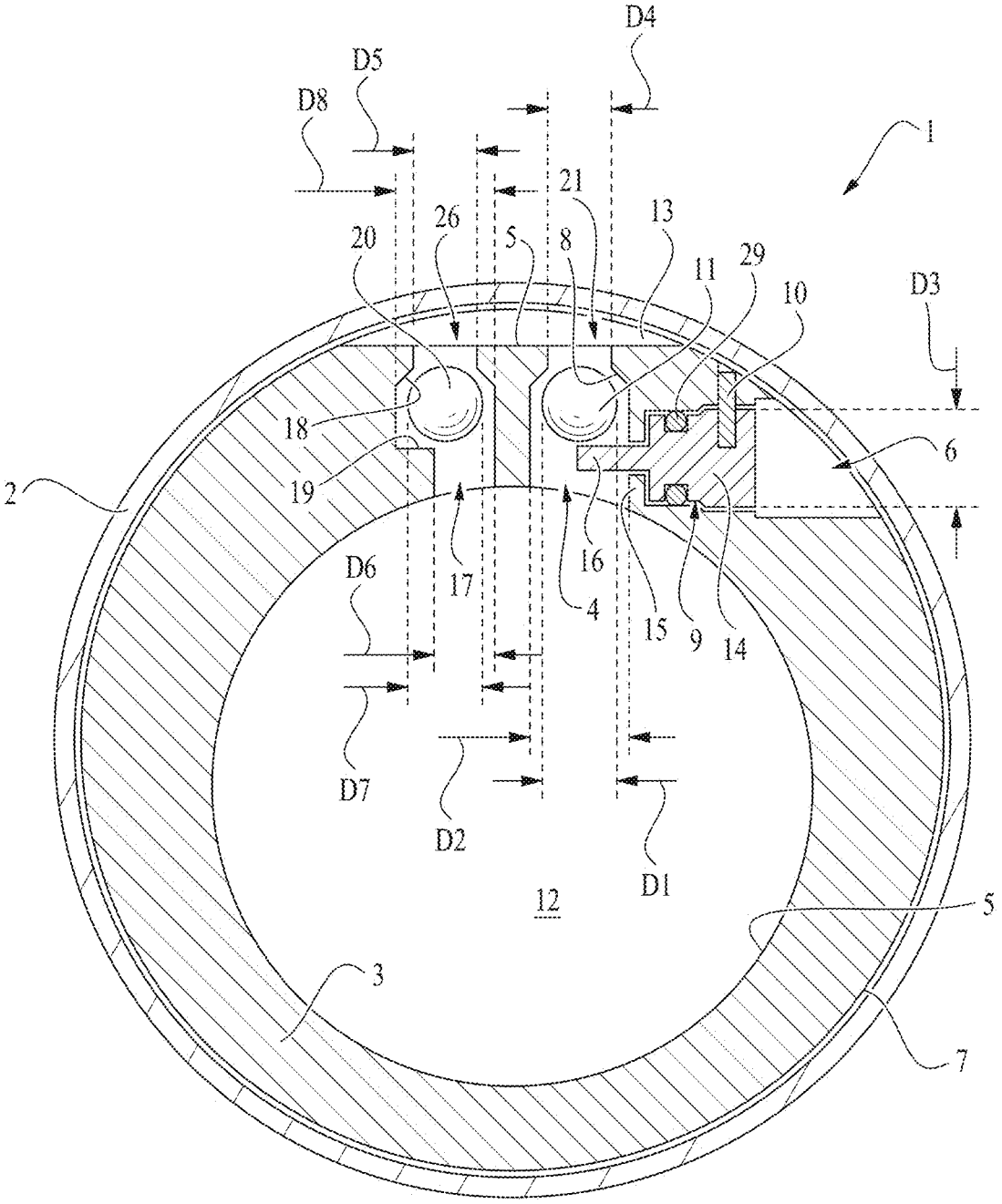
FIG. 4A is a cross-sectional top view of the sand screen assembly of FIG. 3 during run in hole.
Figure 4B:
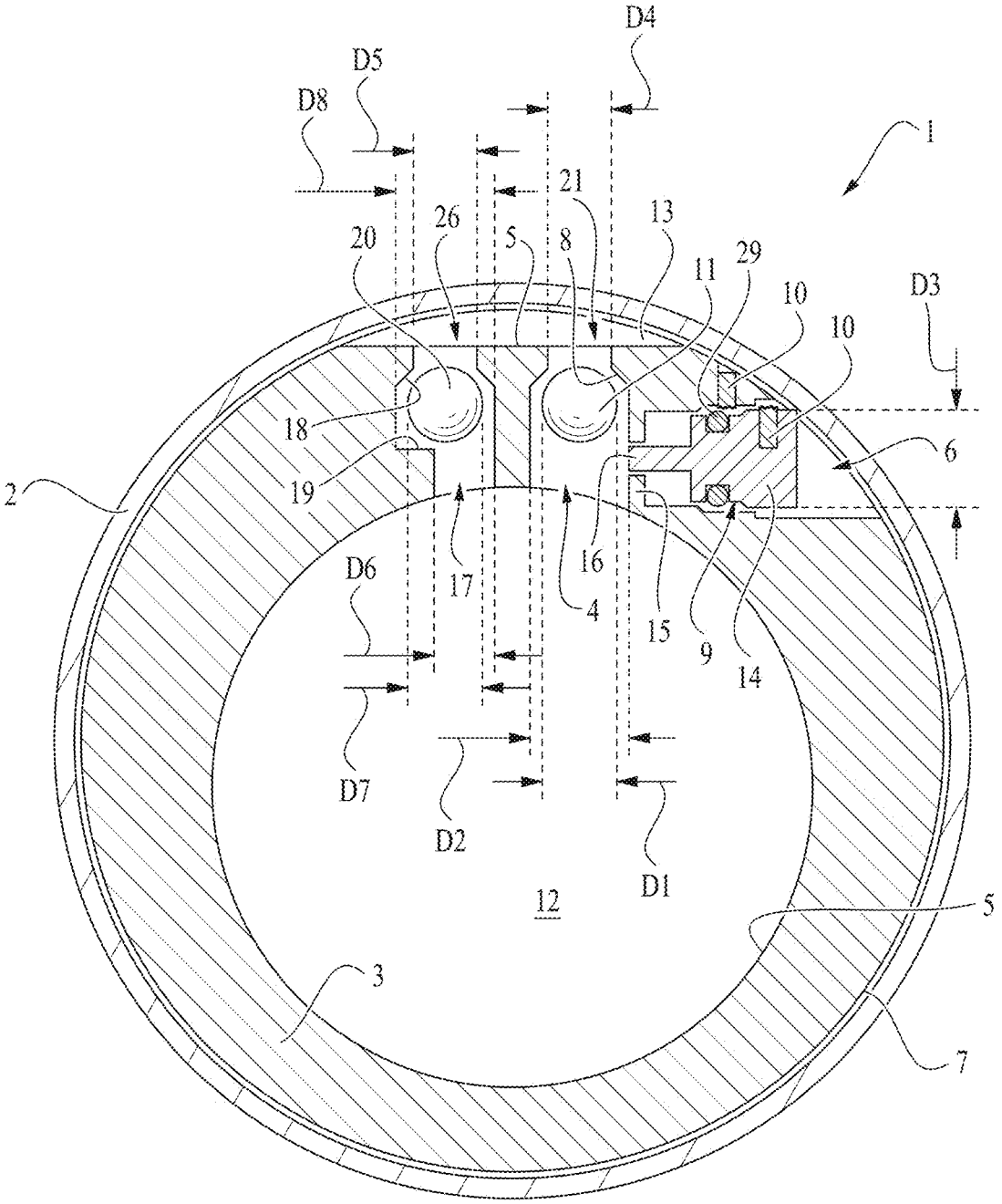
FIG. 4B is a cross-sectional top view of the sand screen assembly of FIG. 3 after pressuring up.
Figure 4C:
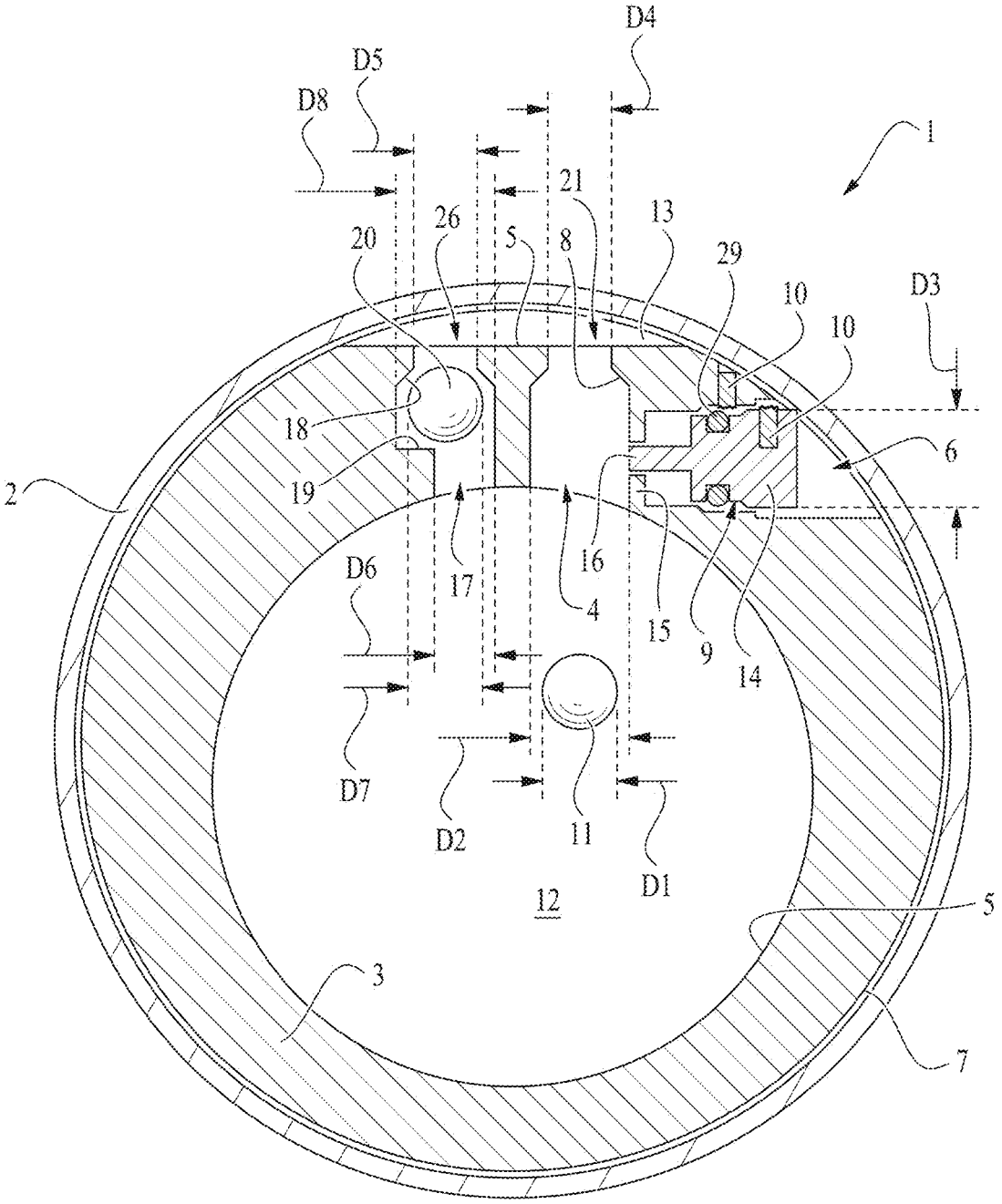
FIG. 4C is a cross-sectional top view of the sand screen assembly of FIG. 3 during production of the check ball.

Referring to FIG. 1, an exemplary wellsite environment 100 is illustrated. In some embodiments, the wellsite environment 100 comprises a wellbore 102 extending from a surface location to a permeable subterranean formation 110. The wellbore 102 can be drilled from the surface location using any suitable drilling technique. The wellbore 102 can include a substantially vertical portion 104 that transitions to a deviated portion and into a substantially horizontal portion 124. In some embodiments, the wellbore 102 may comprise a nonconventional, horizontal, deviated, multilateral, or any other type of wellbore. Wellbore 102 may be defined in part by a casing string 106 that may extend from a surface location to a selected downhole location. The casing string 106 may be isolated from the wellbore by cement 108. Portions of wellbore 102 that do not comprise the casing string 106 may be referred to as open hole. Although the horizontal portion 124 is illustrated as an open hole section, it is understood that the horizontal section can include a casing string 106 and/or cement 108. While the wellsite environment 100 is illustrating a land-based subterranean environment, the present disclosure contemplates any wellsite environment including a subsea environment. In one or more embodiments, any one or more components or elements may be used with subterranean operations equipment located on offshore platforms, drill ships, semi-submersibles, drilling barges, and land-based rigs.

A production string 112 may be positioned within the wellbore 102 and extend from the surface location. The production string 112 can be any piping, tubular, or fluid conduit including, but not limited to, drill pipe, production tubing, casing, coiled tubing, and any combination thereof. The production string 112 provides a conduit for production fluids extracted from the formation 110 to travel to the surface. The production string 112 may additionally provide a conduit for fluids to be conveyed downhole and injected into the formation 110, such as in an injection operation.

In some embodiments, the production string 112 can be releasably coupled to a completion string 114. For example, the production string 112 can be mechanically coupled to the completion string 114 by a coupling 132. The completion string 114 can divide the production zone into various production intervals adjacent to the formation 110. The production zone can be the area within the wellbore 102 where various wellbore operations are to be undertaken using the completion string 114, such as production or injection operations.

As illustrated in FIG. 1, the completion string 114 may include an isolation packer 126 and/or one or more sand screen assemblies 116 (e.g., axially offset from each other along portions of the completion string 114). The isolation packer 126 can anchor and seal the completion string 114 within the production zone. One or more zonal packers 118 can be placed between one or more of the sand screen assemblies 116 to form a seal between the outer surface of the completion string 114 and the inner surface of the wellbore 102, thereby defining corresponding production intervals. In operation, the sand screen assembly 116 can filter particulate matter out of production fluid such that particulates and other fines are not produced to the surface and particulates are prevented from clogging portions of the completion string 114. Although the sand screen assemblies 116 are illustrated as being located in an open hole portion of the wellbore 102, it is understood that one or more of the sand screen assemblies 116 can be arranged within cased portions of the wellbore 102. Although the completion string 114 (e.g., lower completion) is illustrated with multiple production intervals separated by the zonal packers 118, it is understood that the production zone may include 0, 1, 2, 3, 4, 5, 6, 7, 8, 9, 10, or any number of production intervals with a corresponding number of zonal packers 118 used therein. Although the completion string 114 is illustrated in a horizontal portion 124 of the wellbore 102, it is understood that the completion string 114 can be located in a vertical portion 104, a deviated section, a multilateral section, or combinations thereof.

In some embodiments, the completion string 114 can be used to undertake various wellbore operations. For example, the completion string 114 can be used to extract production fluids 120 from the formation 110 and transport those fluids 120 to the surface via the production string 112. The production fluids 120 can be water, oil, gas, acids, or any combination thereof.

In some embodiments, the completion string 114 may be used to inject fluids 122 with various service operations into the surrounding subterranean formation 110. For example, the completion string 114 can be used with hydraulic fracturing operations, steam-assisted gravity drainage (SAGD) operations, wellbore treatment operations, gravel packing operations, acidizing operations, or any combination thereof. Accordingly, the injected fluids 122 may be water, fracturing fluids, steam, gas, aqueous or liquid chemicals, slurry, acids, or any combination thereof.

In some embodiments, the sand screen assembly 116 is provided such that the inside of the screens holds burst pressure while allowing flow from outside to inside (which may help the string self-fill with reservoir-injected hydrocarbons). The sand screen assembly 116 may also allow for this one-way flow to be disabled and two-way flow enabled, which would allow for normal production and the potential for injection later.

The sand screen assembly 116 may comprise a check valve mounted in series with a standalone screen or in series with an ICD or AICD type device. The check valve can be a simple ball and seat type design. Alternatively, the check valve can be a disk type where a disk is produced instead of a ball. The check valve may be disabled remotely via a command from the surface. Once it is desirable for the check valve to be disabled, pressure may be applied from the surface and all of the check valves may go on seat, allowing pressure in the ID of the tubing to increase. Upon reaching a set threshold, the shear pins in a piston may shear and the piston may be shifted. The shifting of the piston may allow the balls to be produced through to the ID of the production tubing to the surface upon removal of the internal pressure.

The sand screen assembly 116 can have any number of check valves in parallel with each other depending upon flow rate requirements in the production or injection direction. If two or more check valves are included in parallel, the system can work only even if only one of the check valves is disabled (e.g., the check ball is released). The check valve(s) that are being disabled can also have a retainer or other restriction that allows for controlling the injection rate through that device.

The check valve ball may be pushed out into the tubing ID very easily, so it likely would not matter if external pressure pushes the piston back under the check valve seat because of the large flow area available. In some embodiments, the piston could also have a lock out feature such as a snap ring to ensure that it never moves back below the check valve seat. If the o-ring on the piston becomes unseated, and the outer cover may protect the piston from seeing external pressure from the reservoir.

In some embodiments, the retainer arm (e.g., rod) or full piston is made from a dissolvable material as a contingency option in case pressure cannot be applied or if one fails to shift. The ball may be buoyant to help float to the surface or heavy so that it stays in the tubing or falls down to the toe in more near vertical applications. In some embodiments, the ball is made of a soft material such as plastic or a light material such as aluminum to avoid damaging components of the completion string as the ball is produced.

Referring to FIGS. 1-5, a system 1000 for producing fluid from a subterranean formation 100 may include a production string 112 and a completion string 114 coupled to the production string 112. The completion string 114 may include a sand screen assembly 116 comprising sand screens 117 and joints 1 coupling together the sand screens 116. Packers 118 may fluidly isolate portions of the sand screen assembly. The joints 1 may comprise check valves 21 configured to release check balls 11 (or other check valve sealing components) into an interior volume of the completion string 114 (e.g., into production tubing 25), in response to pressure inside an interior volume of the sand screen assembly 116 exceeding a threshold and the pressure subsequently being released. That is, the shear pins 10 may break in response to the pressure exceeding the threshold, and when the pressure is released, flow from the formation may carry the check balls into the production tubing 25. The released check balls 11 may be produced through the completion string 114 and through the production string 112 to surface.

Referring to FIGS. 2-5, a joint 1 for a sand screen assembly 116 may include an outer cover 2 and a mandrel 3 disposed inside the outer cover 2 and/or inline with a screen jacket. A first passageway 4 may extend from a chamber surface 5 (e.g., a tangential surface) of the mandrel 3 to an inner circumferential surface 5 of the mandrel 3 (e.g., an interior surface of the production tubing 25 or proximate to an interior surface of the production tubing 25). A second passageway 6 may extend from an outer circumferential surface 7 of the mandrel (e.g., which contacts the outer cover 2) to the first passageway 4. A first ball seat 8 may be formed in the first passageway 4. A retainer 9 may be disposed in the second passageway 6. A shear pin 10 may affix the retainer 9 to the mandrel 3. That is, the shear pin 10 may extend from inside the mandrel 3 to inside the piston 14. A first check ball 11 may be disposed in the first passageway 4. The first check ball 11 may be constrained by the first ball seat 8 and the retainer 9 (e.g., when the shear pin 10 is intact). A diameter D1 of the first check ball 11 may be less than a diameter D2 of the first passageway 4 at the inner circumferential surface 5 so that the ball can exit upon breakage of the shear pin 10. The mandrel 3 may be in fluid communication with a screen-filtered annulus (e.g., fluid from the sand screen 117 may flow through the chamber 13, through the first passageway 4 and/or the third passageway 17, and into the volume 12). The mandrel 3 may be integrally formed with or sealingly engaged with the production tubing 25. The diameter D9 of the first ball seat 8 may be sized to control injection flow rate upon releasing the check ball 11. With a larger diameter D9, more fluid can flow from the volume 12, through the first passageway 4, and through the first ball seat 8 into the chamber 13.

The joint 1 may be configured to release the first check ball 11 from the first passageway 4 into a volume 12 defined by the inner circumferential surface 5 (e.g., an interior of the production tubing 25), in response to the shear pin 10 breaking. The shear pin 10 may be configured to break, in response to pressure inside the volume 12 exceeding a threshold. The chamber 13 may be formed between the chamber surface 5 and the outer cover 2. The chamber 13 may be defined by an inner circumferential surface of the outer cover 2 and the chamber surface 5. The chamber 13 may receive filtered fluid from the sand screen 117. The first passageway 4 may fluidly couple the chamber 13 to the volume 12 (e.g., when the first check ball 11 is off of the first ball seat 8). The third passageway 17 may fluidly couple the chamber 13 to the volume (e.g., when the second check ball 20 is off of the second ball seat 18.

The retainer 9 may comprises a piston 14. A seal 29 may encircle the retainer 9/piston 14 and/or may be disposed in a groove in the piston 14. A diameter D3 of the piston 14 may correspond to a diameter of the second passageway 6 (e.g., the piston 14 slides against the second passageway 6). The second passageway 6 may include an optional piston stop 15 configured to constrain the piston 14 (e.g., prevent translation of the piston 14 beyond a certain point). The piston stop 15 may be integrally formed with the mandrel 3 or may be a separate component. The piston stop 15 may be located at an interface between the second passageway 6 and the first passageway 4. The retainer 9 may further include a rod 16 extending from the piston 14 and protruding through the piston stop 15. The rod 16 and the piston 14 may be integrally formed. The rod 16 may extend from an axial end of the piston 14. When the shear pin 10 is intact, the rod may extend through a hole in the piston stop 15 to contact the check ball 11 and prevent it from falling out into the volume 12. When the shear pin 10 breaks, the retainer 9 may translate within the second passageway, which may pull the rod 16 through the piston stop 15 further inside the second passageway 6. With the rod 16 out of the way, the first check ball 11 may be allowed to drop into the volume 12.

The diameter of the first passageway 4 may be uniform along a length from the first ball seat 8 to the inner circumferential surface 5. That is, the first passageway 4 may have a constant diameter from the opening at the inner circumferential surface 5 to the first ball seat 8. Alternatively, the first passageway may have a varying diameter that is at least as great as the diameter of the first check ball 11 along a length from the first ball seat 8 to the inner circumferential surface 5. The first ball seat 8 may have a smaller diameter than the first check ball 11 so that the first check ball 11 is prevented from entering the chamber 13. The first ball seat 8 may be formed proximate to the chamber surface 5. The first ball seat 8 may be integrally formed with the mandrel 3. A diameter D4 of the first ball seat 8 may be smaller than the diameter D1 of the first check ball 11.

A third passageway 17 may extend from the chamber surface 5 to the inner circumferential surface 5. A second ball seat 18 may be formed in the third passageway 17. The second ball seat 18 may be integrally formed with the mandrel 3 (e.g., at or near the chamber surface 5) or may be a separate component. A ball stop 19 may be disposed in the second passageway 6 proximate to the inner circumferential surface 5. The ball stop 19 may be integrally formed with the mandrel 3 (e.g., at or near the inner circumferential surface 5) or be a separate component. The joint 1 may further include include a second check ball 20 disposed in the third passageway 17. The second check ball 20 may be constrained by the second ball seat 18 and the ball stop 19. The diameter D5 of the second ball seat 18 and the diameter D6 of the ball stop 19 may both be less than the diameter D7 of the second check ball 20, and the diameter D8 of the third passageway 17 may be greater than the diameter D7 of the second check ball 20. The ball stop 19 may be configured to prevent the second ball 20 from being released into the volume 12 (e.g., into the production tubing 25). The first passageway 6 may be parallel to the third passageway 17. The third passageway 17 may fluidly couple the chamber 13 and the volume 12 (e.g., when the second check ball 20 is off of the second ball seat 18).

The joint 1 may also include a flow control device 22 (e.g., an autonomous inflow control device) and/or a sliding side door 23. Fluid may flow from the formation 110, into the sand screen 117, through the flow control device 22, and/or through the check valves (e.g., first check valves 21 and/or second check valves 26) to the interior volume of the joint 1. From there, the fluid may be produced through the completion string 114 and the production string 112. For example, the check valve (e.g., first check valves 21 and second check valves 26) may be between the sand screen 117 and the inner diameter of the tubing 25 in the fluid path. The sand screen 117 may comprise any suitable filtering structure such as a filter media. For example, the sand screen 117 may comprise premium mesh, wire wrap, prepacked screen, slotted shroud, an expandable tube with a mesh surrounding a filter media. The sand screen 117 may comprise a support/core layer, a protective shroud, end rings, or any other suitable structure. The sand screen may surround a base pipe 24.

Figure 5:
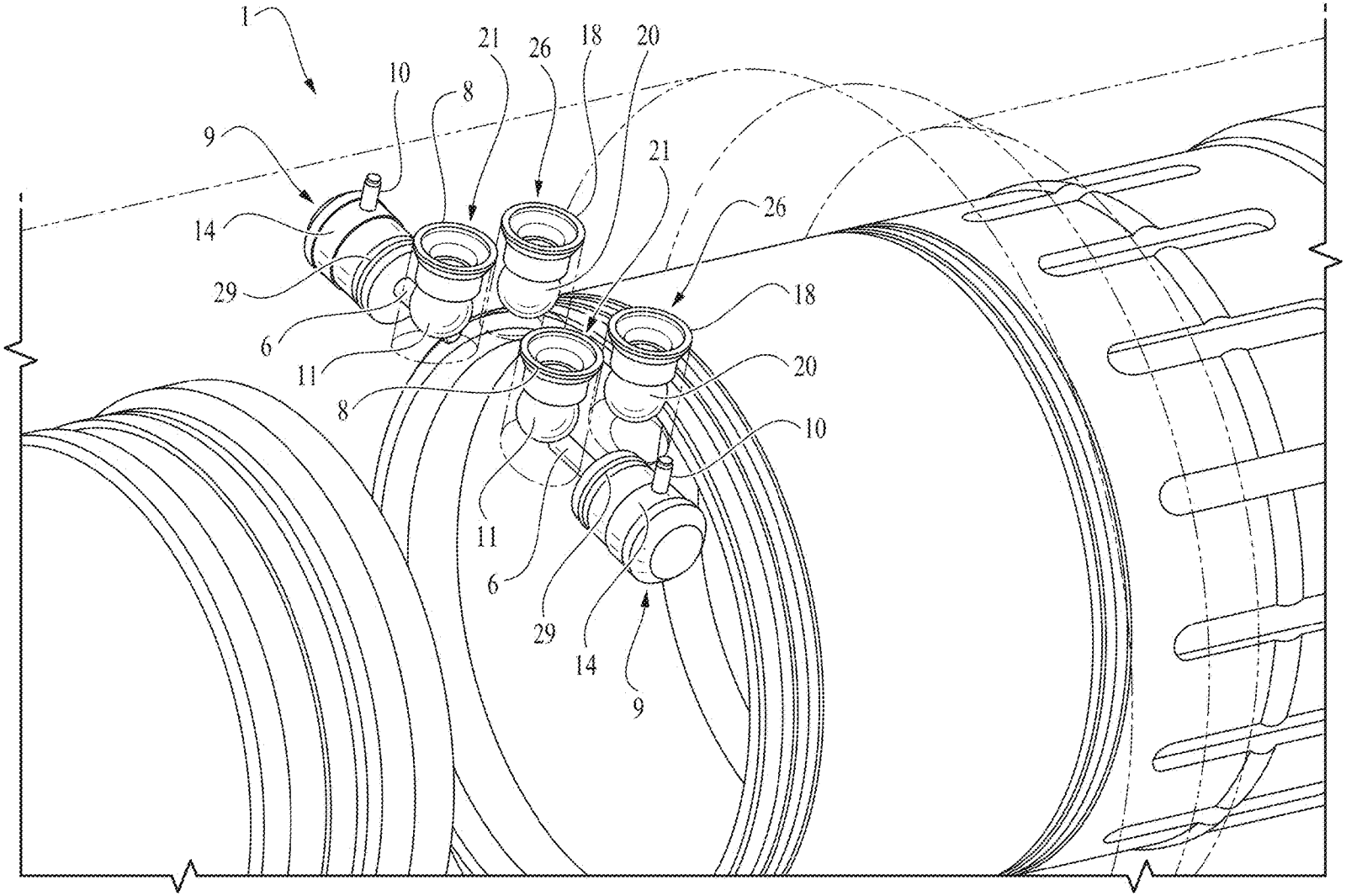
FIG. 5 is a perspective cutaway view of the sand screen assembly of FIG. 3.

Referring to FIG. 5, there may four check valves (e.g., first check valves 21, which may have releasable first check balls 11, and second check valves 26, which may have non-releasable second check balls 20). For example, the first check valves 21 may each include a first check ball 11, a first ball seat 8 (e.g., an elastomeric ring), and a retainer 9. The second check valves 26 may include a second check ball 20 and a second ball seat 18 (e.g., an elastomeric ring). In general, more flow is needed for production than injections. Thus, only releasing some of the balls may enable sufficient flow for injection even through the remaining balls are retained. Another consideration is that the released balls could open up more space in the first passageway 4 (see FIG. 4) for additional flow. Another consideration is that retaining some balls while releasing some balls could allow the joint 1 to act as a restriction device for injection to help distribute the flow (e.g., similar to a reverse soaker hose). In various embodiments, there could be more than two non-releasable check valves (e.g., 3, 4, 5, 6, 7, 8, 9, 10, or more) and/or more than two releasable check valves (e.g., 3, 4, 5, 6, 7, 8, 9, 10, or more). In some embodiments, the releasable first check valves 21 have shear pins 10 with different sizes or strengths such that they release at different pressures, thus allowing for more flexibility and/or greater complexity of operations.

Figure 6:
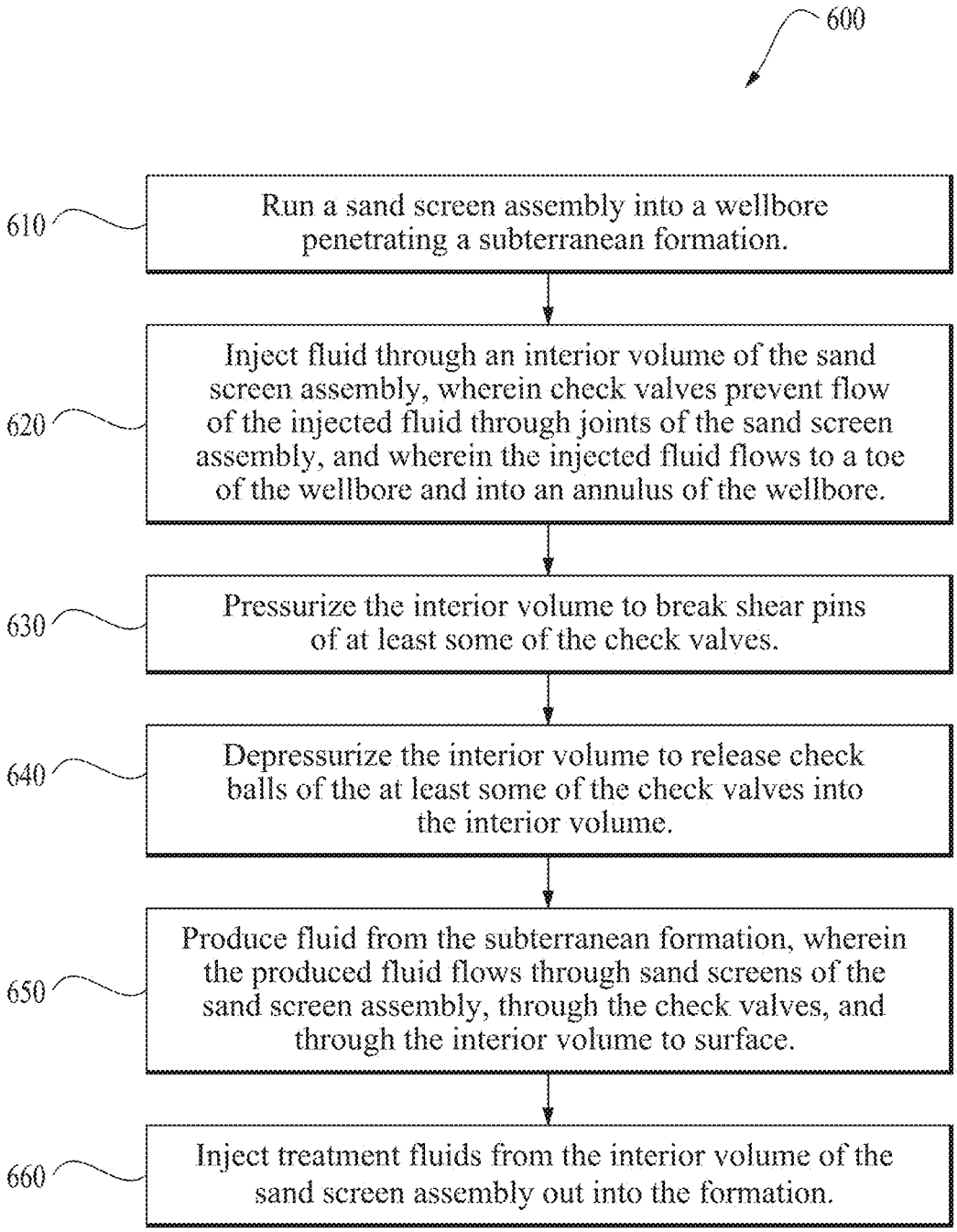
FIG. 6 is a flow diagram of an exemplary method for producing fluid from a subterranean formation.

Referring to FIG. 6, and exemplary method 600 for producing fluid from a subterranean formation may include the step 610 of running a sand screen assembly (e.g., sand screen assembly 116 shown in FIG. 2) into a wellbore penetrating the subterranean formation (e.g., run-in of the sand screen assembly). The method 600 may further include the step 620 of injecting fluid (e.g., during or after run-in) through an interior volume of the sand screen assembly to clear debris (e.g., injecting heavy fluid such as mud to keep a heavy fluid column on top to prevent the well from starting up). Check valves may prevent flow of the injected fluid through joints of the sand screen assembly (e.g., to prevent a fluid short circuit in which the fluid does not reach the toe of the wellbore). The injected fluid may flow to a toe of the wellbore and into an annulus of the wellbore (e.g., between the sand screen assembly and the formation or the ID of the wellbore). The method 600 may further include the step 630 of pressurizing the interior volume to break shear pins of at least some of the check valves. The method 600 may further include the step 640 of depressurizing the interior volume to release check balls of the at least some of the check valves into the interior volume (e.g. first check balls, which are associated with first check valves, are released, and second check balls, which are associated with second check valves, are retained). In some embodiments, the released check balls are produced to surface. The method 600 may further include the step 650 of producing fluid from the subterranean formation such that the produced fluid flows through sand screens of the sand screen assembly, through the check valves, and through the interior volume (e.g., through a production tubing) to surface. The method 600 may further include the step of injecting fluid into the wellbore after the first check balls have been released. This injected fluid may pass through the first check valves and into the chamber to clear debris or for other purposes. For example, fluid may be produced through the tool and if needed fluid can be injected to eliminate scale build up inside the tool. Injection through the flow control device may be for pumping acids into the formation to increase formation permeability or scale removal. Such procedures may be done after production through the formation declines over time. The method may include the step 660 of injecting treatment fluids from the interior volume of the sand screen assembly out into the formation.

The running in of the sand screen assembly may include pumping down the production tubing out all the way to the toe and around into the annulus to flush out a clog or help the production tubing get pushed past a restriction in the formation. The ball valves may come off of the seats, which may prevent a fluid short circuit (e.g., fluid may be prevented from flowing from the production tubing through the check valves to the chamber and/or the sand screens). Packers may be hydraulically set. The interior of the production tubing may be pressured up to a first pressure (e.g., to 3,000 psi) to activate a hydraulically set packer. The tubing may be further pressured up to a second pressure (e.g., to 4,000 psi) that is greater than the first pressure, which may break the shear pins. After holding at the second pressure for a time period (e.g., 15 minutes), the pressure may be released. Flow (e.g., during startup production) may move the balls off the seats and the releasable balls may be released into the interior of the production tubing (e.g., the interior volume). After the balls have been released, fluid may be injected through the interior volume of the sand screen assembly and through the check valves that have released their balls (e.g., through the first passageways). Production may be started by injecting lighter fluid to reduce the fluid column of heavy fluid (e.g., mud).

The method 600 may further include producing the check balls to the surface. In some embodiments, each of the joints includes an outer cover and a mandrel disposed inside the outer cover. A first passageway may extend from a chamber surface of the mandrel to an inner circumferential surface of the mandrel. A second passageway may extend from an outer circumferential surface of the mandrel to the first passageway. A ball seat may be formed in the first passageway. A retainer may be disposed in the second passageway. A shear pin, of the shear pins, may affix the retainer to the mandrel. A check ball, of the check balls, may be disposed in the first passageway. The check ball may be constrained by the ball seat and the retainer. A diameter of the check ball may be less than a diameter of the first passageway at the inner circumferential surface.

In the conventional art, the balls not being produced completely out of the way may create a risk that high injection flow could pull the balls back on seat during an injection scenario. The system and method of the present disclosure may present the advantage in that the balls are produced completely out of the way, thus eliminating this risk. The system and method of the present disclosure may also present the advantage of avoiding the need for a washpipe, because before the release, the check valves allow the tubing to perform much the same function as a washpipe, and after the release of the check balls, it is as if the wash pipe has been removed. The system and method of the present disclosure may also present the advantage of avoiding the need to straddle hydraulically set packers.

ADDITIONAL DISCLOSURE

The following are non-limiting, specific embodiments in accordance with the present disclosure:

In a first embodiment, a joint for a sand screen assembly comprises an outer cover; a mandrel disposed inside the outer cover, wherein a first passageway extends from a chamber surface of the mandrel to an inner circumferential surface of the mandrel, wherein a second passageway extends from an outer circumferential surface of the mandrel to the first passageway, and wherein a first ball seat is formed in the first passageway; a retainer disposed in the second passageway; a shear pin affixing the retainer to the mandrel; and a first check ball disposed in the first passageway, wherein the first check ball is constrained by the first ball seat and the retainer, and wherein a diameter of the first check ball is less than a diameter of the first passageway at the inner circumferential surface A second embodiment can include the joint of the first embodiment, wherein the joint is configured to release the first check ball from the first passageway into a volume defined by the inner circumferential surface, in response to the shear pin breaking.

A third embodiment can include the joint of the first or second embodiments, wherein the shear pin is configured to break, in response to pressure inside the volume exceeding a threshold A fourth embodiment can include the joint of any of the first through third embodiments, wherein a chamber is formed between the chamber surface and an inner surface of the outer cover.

A fifth embodiment can include the joint of any of the first through fourth embodiments, wherein the retainer comprises a piston, and a diameter of the piston corresponds to a diameter of the second passageway.

A sixth embodiment can include the joint of any of the first through fifth embodiments, wherein the second passageway comprises a piston stop configured to constrain the piston.

A seventh embodiment can include the joint of any of the first through sixth embodiments, wherein the retainer further comprises a rod extending from the piston and protruding through the piston stop.

An eighth embodiment can include the joint of any of the first through seventh embodiments, wherein the diameter of the first passageway is uniform along a length from the first ball seat to the inner circumferential surface.

A ninth embodiment can include the joint of any of the first through eighth embodiments, wherein the first ball seat is formed proximate to the chamber surface.

A tenth embodiment can include the joint of any of the first through ninth embodiments, wherein a third passageway extends from the chamber surface to the inner circumferential surface, a second ball seat is formed in the third passageway proximate to the chamber surface, and a ball stop is formed in the third passageway proximate to the inner circumferential surface.

An eleventh embodiment can include the joint of any of the first through tenth embodiments, further comprising a second check ball disposed in the second passageway.

A twelfth embodiment can include the joint of any of the first through eleventh embodiments, wherein the second check ball is constrained by the second ball seat and the ball stop.

A thirteenth embodiment can include the joint of any of the first through twelfth embodiments, wherein the ball stop is configured to prevent the second ball from being released into the volume.

A fourteenth embodiment can include the joint of any of the first through thirteenth embodiments, wherein the first passageway is parallel to the third passageway.

In a fifteenth embodiment, a method for producing fluid from a subterranean formation includes running a sand screen assembly into a wellbore penetrating the subterranean formation; injecting fluid through an interior volume of the sand screen assembly to clear debris, wherein check valves prevent flow of the injected fluid through joints of the sand screen assembly, and wherein the injected fluid flows to a toe of the wellbore and into an annulus of the wellbore; pressurizing the interior volume to break shear pins of at least some of the check valves; depressurizing the interior volume to release check balls of the at least some of the check valves into the interior volume; and producing fluid from the subterranean formation, wherein the produced fluid flows through sand screens of the sand screen assembly, through the check valves, and through the interior volume to surface.

A sixteenth embodiment can include the method of the fifteenth embodiment, further comprising producing the check balls to the surface.

A seventeenth embodiment can include the method of the fifteenth or sixteenth embodiments, wherein each of the joints comprises an outer cover; a mandrel disposed inside the outer cover, wherein a first passageway extends from a chamber surface of the mandrel to an inner circumferential surface of the mandrel, wherein a second passageway extends from an outer circumferential surface of the mandrel to the first passageway, and wherein a ball seat is formed in the first passageway; a retainer disposed in the second passageway; a shear pin, of the shear pins, affixing the retainer to the mandrel; and a check ball, of the check balls, disposed in the first passageway, wherein the check ball is constrained by the ball seat and the retainer, and wherein a diameter of the check ball is less than a diameter of the first passageway at the inner circumferential surface.

In an eighteenth embodiment, a system for producing fluid from a subterranean formation includes a production string; and a completion string coupled to the production string, the completion string comprising a sand screen assembly comprising sand screens and joints coupling together the sand screens; and packers fluidly isolating portions of the sand screen assembly, wherein the joints comprise check valves configured to release check balls into an interior volume of the completion string, in response to pressure inside an interior volume of the sand screen assembly exceeding a threshold and the pressure subsequently being released.

A nineteenth embodiment can include the system of the eighteenth embodiment, wherein the released check balls are produced through the completion string and through the production string to surface.

A twentieth embodiment can include the system of the eighteenth or nineteenth embodiments, wherein each of the joints comprises an outer cover; a mandrel disposed inside the outer cover, wherein a first passageway extends from a chamber surface of the mandrel to an inner circumferential surface of the mandrel, wherein a second passageway extends from an outer circumferential surface of the mandrel to the first passageway, and wherein a ball seat is formed in the first passageway; a retainer disposed in the second passageway; a shear pin affixing the retainer to the mandrel; and a check ball, of the check balls, disposed in the first passageway, wherein the check ball is constrained by the ball seat and the retainer, and wherein a diameter of the check ball is less than a diameter of the first passageway at the inner circumferential surface.

In a twenty-first embodiment, a joint for a sand screen assembly comprises a mandrel disposed inline with a screen jacket, wherein a first passageway extends through the mandrel to an inner circumferential surface of the mandrel, wherein a second passageway extends through the mandrel to the first passageway, and wherein a first ball or disc seat is formed in the first passageway; a retainer disposed in the second passageway; a shear member affixing the retainer to the mandrel; and a first check ball or disc disposed in the first passageway, wherein the first check ball or disc is constrained by the first ball or disc seat and the retainer, and wherein a diameter of the first check ball or disc is less than a diameter of the first passageway at the inner circumferential surface.

A twenty-second embodiment can include the joint of the twenty-first embodiment, wherein the joint is configured to release the first check ball or disc from the first passageway into a volume defined by the inner circumferential surface, in response to the shear member breaking.

A twenty-third embodiment can include the joint of the twenty-first or twenty-second embodiments, wherein the shear member is configured to break, in response to pressure inside the volume exceeding a threshold.

A twenty-fourth embodiment can include the joint of any of the twenty-first through twenty-third embodiments, wherein a chamber is formed between a chamber surface of the mandrel and an inner surface of the outer cover.

A twenty-fifth embodiment can include the joint of any of the twenty-first through twenty-fourth embodiments, wherein the retainer comprises a piston, and a diameter of the piston corresponds to a diameter of the second passageway.

A twenty-sixth embodiment can include the joint of any of the twenty-first through twenty-fifth embodiments, wherein the second passageway comprises a piston stop configured to constrain the piston.

A twenty-seventh embodiment can include the joint of any of the twenty-first through twenty-sixth embodiment, wherein the retainer further comprises a rod extending from the piston and protruding through the piston stop.

A twenty-eighth embodiment can include the joint of any of the twenty-first through twenty-seventh embodiments, wherein the diameter of the first passageway is uniform along a length from the first ball seat to the inner circumferential surface.

A twenty-ninth embodiment can include the joint of any of the twenty-first through twenty-eighth embodiments, wherein the first ball or disk seat is formed proximate to the chamber surface.

A thirtieth embodiment can include the joint of any of the twenty-first through twenty-ninth embodiments, wherein a third passageway extends from the chamber surface to the inner circumferential surface, a second ball or disk seat is formed in the third passageway proximate to the chamber surface, and a ball or disk stop is formed in the third passageway proximate to the inner circumferential surface.

A thirty-first embodiment can include the joint of any of the twenty-first through thirtieth embodiments, further comprising a second check ball or disk disposed in the second passageway.

A thirty-second embodiment can include the joint of any of the twenty-first through thirty-first embodiment, wherein the second check ball or disk is constrained by the second ball or disk seat and the ball or disk stop.

A thirty-third embodiment can include the joint of any of the twenty-first through thirty-second embodiments, wherein the ball or disk stop is configured to prevent the second ball or disk from being released into a volume defined by the inner circumferential surface.

A thirty-fourth embodiment can include the joint of any of the twenty-first through thirty-third embodiments, wherein the first passageway is parallel to the third passageway.

In a thirty-fifth embodiment, a method for producing fluid from a subterranean formation comprises running a sand screen assembly into a wellbore penetrating the subterranean formation; injecting fluid through an interior volume of the sand screen assembly, wherein check valves prevent flow of the injected fluid through joints of the sand screen assembly, and wherein the injected fluid flows to a toe of the wellbore and into an annulus of the wellbore; pressurizing the interior volume to break shear members of at least some of the check valves; depressurizing the interior volume to release check balls or disks of the at least some of the check valves into the interior volume; and producing fluid from the subterranean formation, wherein the produced fluid flows through sand screens of the sand screen assembly, through the check valves, and through the interior volume to surface.

A thirty-sixth embodiment can include the method of the thirty-fifth embodiment, further comprising producing the check balls or disks to the surface.

A thirty-seventh embodiment can include the method of the thirty-fifth or thirty-sixth embodiment, wherein each of the joints comprises a mandrel disposed inline with a screen jacket of the sand screen assembly, wherein a first passageway extends through the mandrel to an inner circumferential surface of the mandrel, wherein a second passageway extends through the mandrel to the first passageway, and wherein a ball or disk seat is formed in the first passageway; a retainer disposed in the second passageway; a shear member, of the shear members, affixing the retainer to the mandrel; and a check ball or disk, of the check balls or disks, disposed in the first passageway, wherein the check ball or disk is constrained by the ball or disk seat and the retainer, and wherein a diameter of the check ball or disk is less than a diameter of the first passageway at the inner circumferential surface.

In thirty-eighth embodiment, a system for producing fluid from a subterranean formation comprises a production string; and a completion string coupled to the production string, the completion string comprising: a sand screen assembly comprising sand screens and joints coupling together the sand screens; and packers fluidly isolating portions of the sand screen assembly, wherein the joints comprise check valves configured to release check balls or disks into an interior volume of the completion string, in response to pressure inside an interior volume of the sand screen assembly exceeding a threshold and the pressure subsequently being released.

A thirty-ninth embodiment can include the system of the thirty-eighth embodiment, wherein the released check balls or disks are produced through the completion string and through the production string to surface.

A fortieth embodiment can include the system of the thirty-eighth or thirty-ninth embodiments, wherein each of the joints comprises: a mandrel disposed inline with a jacket screen of the sand screen assembly, wherein a first passageway extends through the mandrel to an inner circumferential surface of the mandrel, wherein a second passageway extends through the mandrel to the first passageway, and wherein a ball or disk seat is formed in the first passageway; a retainer disposed in the second passageway; a shear member affixing the retainer to the mandrel; and a check ball or disk, of the check balls or disks, disposed in the first passageway, wherein the check ball or disk is constrained by the ball or disk seat and the retainer, and wherein a diameter of the check ball or disk is less than a diameter of the first passageway at the inner circumferential surface.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations. For example, whenever a numerical range with a lower limit, $R_1$, and an upper limit, Ru, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. Any discussion of a reference herein is not an admission that it is prior art. Any disclosures of all patents, patent applications, and/or publications cited herein are hereby incorporated by reference, to the extent that they provide exemplary, procedural, or other details supplementary to those set forth herein.

As used herein, the term "or" does not require selection of only one element. Thus, the phrase "A or B" is satisfied by either one or both elements from the set {A, B}. A clause that recites "A or B" can be infringed with only one of the listed items, both of the listed items, multiples of the listed items, and one or both of the listed items and another item not listed. The phrase "A, B, or C" is satisfied by any one or any combination of any two or more from the set {A, B, C}. A clause that recites "A, B, or C" can be infringed with only one of the listed items, multiples of the listed items, and one or more of the items from the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A joint for a sand screen assembly, comprising:

a mandrel disposed inline with a screen jacket, wherein a first passageway extends through the mandrel to an inner circumferential surface of the mandrel, wherein a second passageway extends through the mandrel to the first passageway, wherein a first seat is formed in the first passageway, wherein a third passageway extends through the mandrel, and wherein a second seat and a stop are formed in the third passageway;

a retainer disposed in the second passageway, wherein the retainer comprises a piston, and wherein a diameter of the piston corresponds to a diameter of the second passageway;

a shear member affixing the retainer to the mandrel;

a first check ball disposed in the first passageway, wherein the first check ball is constrained by the first seat and the retainer, and wherein a diameter of the first check ball is less than a diameter of the first passageway at the inner circumferential surface; and a second check ball disposed in the third passageway, wherein the second check ball is constrained by the second seat and the stop.

2. The joint of claim 1, wherein the joint is configured to release the first check ball from the first passageway into a volume defined by the inner circumferential surface, in response to the shear member breaking.

3. The joint of claim 2, wherein the shear member is configured to break, in response to pressure inside the volume exceeding a threshold.

4. The joint of claim 1, wherein a chamber is formed between a chamber surface of the mandrel and an inner surface of an outer cover.

5. The joint of claim 4, wherein the first seat is formed proximate to the chamber surface.

6. The joint of claim 4, wherein the third passageway extends from the chamber surface to the inner circumferential surface, the second seat is disposed proximate to the chamber surface, and the stop is formed in the third passageway proximate to the inner circumferential surface.

7. The joint of claim 4, wherein the first seat is disposed proximate to the chamber surface.

8. The joint of claim 4, wherein the second seat is disposed proximate to the chamber surface.

9. The joint of claim 1, wherein the second passageway comprises a piston stop configured to constrain the piston.

10. The joint of claim 9, wherein the retainer further comprises a rod extending from the piston and protruding through the piston stop.

11. The joint of claim 10, wherein the rod retains the first check ball.

12. The joint of claim 11, wherein the retainer further comprises a seal encircling the piston.

13. The joint of claim 1, wherein the diameter of the first passageway is uniform along a length from the first seat to the inner circumferential surface.

14. The joint of claim 1, wherein the stop is configured to prevent the second check ball from being released into a volume defined by the inner circumferential surface.

15. The joint of claim 14, wherein the first passageway is parallel to the third passageway.

16. The joint of claim 1, wherein the first seat and the second seat are disposed proximate to a chamber surface of the mandrel.

17. The joint of claim 1, wherein the stop is formed in the third passageway proximate to the inner circumferential surface.

18. The joint of claim 1, wherein the first passageway is parallel to the third passageway.

19. The joint of claim 1, wherein the first check ball is releasable.

20. The joint of claim 19, wherein the second check ball is non-releasable.

* * * * *